US007501103B2

(12) United States Patent
Oeste

(10) Patent No.: US 7,501,103 B2
(45) Date of Patent: Mar. 10, 2009

(54) TROPOSPHERIC VOLUME ELEMENTS ENRICHED WITH VITAL ELEMENTS AND/OR PROTECTIVE SUBSTANCES

(75) Inventor: Franz-Dietrich Oeste, Tannenweg 2, D-35274 Kirchhain (DE)

(73) Assignees: Ernst Ries, Hosenfeld (DE); Franz-Dietrich Oeste, Kirchhain (DE)

( * ) Notice: Subject to any disclaimer, the term of this patent is extended or adjusted under 35 U.S.C. 154(b) by 503 days.

(21) Appl. No.: 10/484,730

(22) PCT Filed: Jul. 29, 2002

(86) PCT No.: PCT/DE02/02766

§ 371 (c)(1),
(2), (4) Date: Oct. 7, 2004

(87) PCT Pub. No.: WO03/013698

PCT Pub. Date: Feb. 20, 2003

(65) Prior Publication Data

US 2005/0106061 A1 May 19, 2005

(30) Foreign Application Priority Data

| | | |
|---|---|---|
| Jul. 31, 2001 | (DE) | 101 37 178 |
| Mar. 25, 2002 | (DE) | 102 13 317 |
| Apr. 22, 2002 | (DE) | 102 17 932 |

(51) Int. Cl.

| | |
|---|---|
| ***A62D 3/30*** | (2007.01) |
| ***B01D 53/00*** | (2006.01) |
| ***F23C 99/00*** | (2006.01) |
| ***G21F 9/02*** | (2006.01) |

(52) U.S. Cl. ..... 423/210; 423/644; 48/127.3; 208/14; 44/300; 44/412; 44/436; 44/457; 588/1; 588/249; 588/249.5; 588/256; 588/261; 588/300; 588/900; 588/901; 252/372

(58) Field of Classification Search ..... 423/210, 423/644; 48/127.3; 208/14; 44/300, 457, 44/412, 436; 588/1, 300, 249, 249.5, 261, 588/900, 901, 256; 252/372
See application file for complete search history.

(56) References Cited

U.S. PATENT DOCUMENTS 1,748,604 A * 2/1930 Heimburger ..... 239/434.5

(Continued)

FOREIGN PATENT DOCUMENTS

CN 1259393 A 7/2000

(Continued)

OTHER PUBLICATIONS

The English abstract of CN 1,259,393 A published Jul. 12, 2000.*

(Continued)

*Primary Examiner*—Timothy C Vanoy
(74) *Attorney, Agent, or Firm*—Crowell & Moring LLP

(57) ABSTRACT

Tropospheric volume elements enriched with vital elements and/or protective substances as well as procedures for their production and application. The term "vital elements" applies to all matter supporting the development of life within the earth's biosphere and the term "protective substances" means all those substances which contribute directly or indirectly to the prevention of harmful effects on the earth's biosphere and in particular on man. Tropospheric volume elements in the form of clouds which contain contaminants and which can escape from industrial facilities due to damage or malfunction are enriched with protective substances which prevent the organism from taking in radioactive elements and minimize the extent of the area affected by the clouds and possess additional warning and identification properties.

11 Claims, 1 Drawing Sheet

U.S. PATENT DOCUMENTS

| | | | | |
|---|---|---|---|---|
| 2,967,878 | A * | 1/1961 | Fenske et al. | 568/955 |
| 3,806,583 | A * | 4/1974 | Dewell | 423/262 |
| 4,704,942 | A | 11/1987 | Barditch | |
| 4,997,632 | A * | 3/1991 | Rodewald | 423/240 R |
| 6,066,295 | A | 5/2000 | Bernstein | |
| 6,555,079 | B2 * | 4/2003 | Hoke et al. | 423/210 |
| 6,616,903 | B2 * | 9/2003 | Poles et al. | 423/210 |

FOREIGN PATENT DOCUMENTS

| | | | |
|---|---|---|---|
| DE | 195 02 548 | A | 8/1995 |
| DE | 195 02 548 | A1 * | 8/1995 |
| DE | 19502548 | A | 8/1995 |

OTHER PUBLICATIONS

Abstract of CN 1259393, Database WPI No. XP002230560.

* cited by examiner

TROPOSPHERIC VOLUME ELEMENTS ENRICHED WITH VITAL ELEMENTS AND/OR PROTECTIVE SUBSTANCES

BACKGROUND OF THE INVENTION

This invention relates to tropospheric volume elements enriched with vital elements and/or protective substances as well as the procedures for their production and application. The term "vital elements" applies to all matter supporting the development of life within the earth's biosphere and the term "protective substances" means all those substances which contribute directly or indirectly to the prevention of harmful effects on the earth's biosphere and in particular on man.

Tropospheric volume elements according to the invention are enriched with vital elements and/or protective substances. Tropospheric volume elements in the form of clouds which contain contaminants and which can escape from industrial facilities due to damage or malfunction are enriched with protective substances which prevent the organism from taking in radioactive elements and minimize the extent of the area affected by the clouds and possess additional warning and identification properties.

Enriched tropospheric volume elements may offer numerous advantageous effects, the most important of which are:

Climate cooling and climate stabilization

Increase of food production

Production of methane hydrate and kerogen as renewable energy sources

Reduction in all sorts of air pollutants

Increase of precipitation and

Reduction of the extent of damage and the number of victims due to nuclear reactor accidents.

The components of the environment include the populated and the unpopulated parts of the earth's surface and neighboring areas, including the atmosphere, the surface of the earth, ground, sediment, sediment surface, stretches of water and ecological systems. These components are linked with each other by cycles of material exchange which are all connected to each other by partly instable flux exchange balances. Consequently, the complex system may exist in differing, more or less stable phases. Relatively minor causes may trigger off the transition from one phase to another. Climate phase transitions are recognized as being particularly disadvantageous. The geological climate history of the ice age has shown us that the transition of the earth's climate from the ice age's cold climate to the warm age's hot climate may only take a few years to be completed.

At present, we are experiencing the transition from the moderate to the hot climate phase. This is a result of the rise in the quantities of greenhouse gases methane and $CO_2$ which has been caused by man since the early $19^{th}$ century, whereby the methane content growth is also coupled with the troposphere's diminishing power of self-purification. The increase in methane in the troposphere is also coupled with the decomposition of solid methane hydrate in the tundra moor sediments and in the ocean sediments to free quantities of methane due to the rise in temperature.

There has been a demand for large-scale geo-engineering projects (P. J. Crutzen, *Nature*, Vol. 415 of Jan. 3, 2002) for a lasting correction of the climate development in the near future. There have been various proposals on how to prevent the transition to the hot climate phase; the enrichment of the stratosphere with aerosols with sulfur dioxide (M. Budyko) or soot (P. J. Crutzen) is supposed to cool the troposphere. The costs for such a project are estimated to be more than 20 billion US $ (Graedel, T. E., Crutzen, P. J.: *Chemie der Atmosphäre, Spektrum Ahademischer Verlag*, Heidelberg/Berlin/Oxford [1994], pages 457, 458). At present, attempts are being made to come to international agreements to reduce the release of carbon dioxide by limiting the combustion of fossil energy sources. However, the attempts to gain acceptance of the so-called Kyoto protocol have shown that such a measure cannot be put into practice world-wide.

Without intervention, the warming of the troposphere will continue. The result will be an increase in food scarcity and an increase in the area of land which is salted and devastated. The continuous growth of the world's population will cause a rise in distribution conflicts. Overgrazing, fire clearance and ground erosion will accelerate this negative development. In spite of an increase in the utilization of sea area for fish farming, over-fishing of the oceans has already prompted a dramatic recession in food production.

In the near future, fossil fuel resources are also expected to run short. A compensation by extension of alternative energy sources and energy-saving measures cannot be enforced in the world's poorer regions due to the required investments.

The Chernobyl disaster was triggered off due to the nuclear fission of nuclear fuel in the reactor running out of control; the cloud of radioactive flue gas released by the nuclear reaction and the fire the nuclear reaction caused in the reactor and moderator unit struck large parts of Europe. Terror acts, such as crashing civilian large capacity aircraft onto the towers in New York, have shown that catastrophes repeat themselves. Safety scenarios which have not considered this, have since lost their validity. In all of the nuclear power plants world-wide, there are no safety installations which are capable of reducing the spread of radioactive clouds, which can occur when a nuclear reactor runs out of control, which can limit their effects and which can mark the emission visibly for everybody at the affected spots. The argument that nuclear power plants will be put out of operation world-wide within a few decades is unacceptable, as even the German authorities have guaranteed the operation of at least some nuclear power plants for more than thirty years to come. In Europe, the erection of new nuclear power plants continues, the latest examples of which are the nuclear power plant built in Temelin and another planned in Finland. There are also no safety installations for the treatment and identification of toxic clouds in those industrial facilities which handle highly toxic materials or dangerous microbes.

SUMMARY OF THE INVENTION

According to the invention, the bundle of problems pictured above is solved by the production of definite tropospheric volume elements enriched with vital elements and/or protective substances. Here, "vital elements" means all elements which support the development of life within the earth's biosphere and "protective substances" means all those substances which contribute directly or indirectly to the prevention of harmful effects on the earth's biosphere and the life-forms it contains.

The production of tropospheric volume elements enriched with protective substances and/or vital elements, which may be of global, regional or local extent, is carried out preferably by releasing flue gases according to the invention into the tropospheric air space above the desired area to be affected. The purpose of the addition of flue gases according to the invention is the distribution of protective substances and/or vital elements in the troposphere over the desired area to be affected, to have them remain there for a period of time before they finally sink down onto the surface of the ground and/or water. The flue gases according to the invention used for this purpose are enriched with protective substances and/or vital elements. Belonging to the substances under the term protective substances are also those substances which will develop into protective properties in particular in the troposphere.

DETAILED DESCRIPTION OF THE PREFERRED EMBODIMENTS

Figure 1:
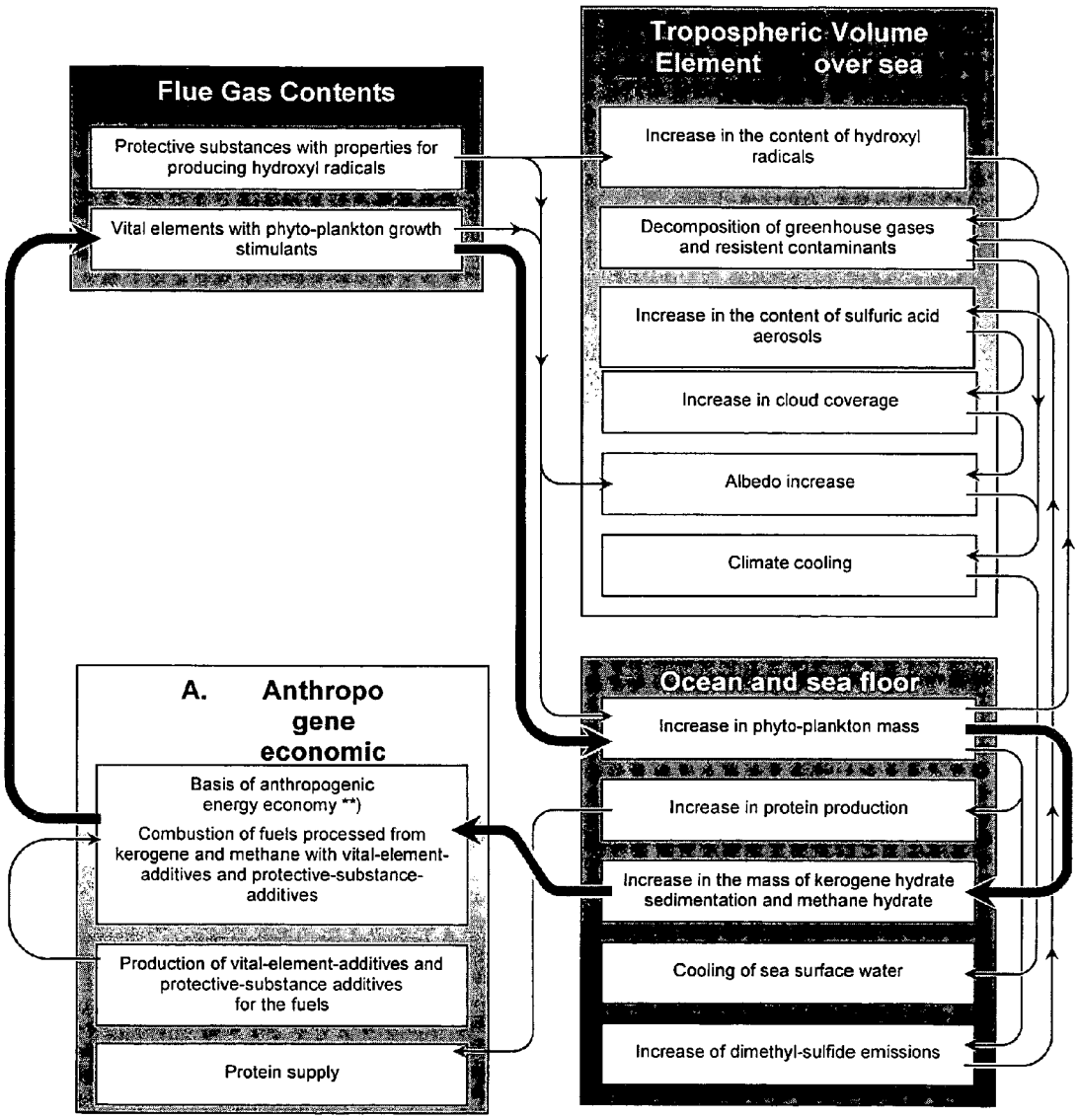
FIG. 1 is a diagram showing the oceanic tropospheric volume element, enriched with vital and protective substances, over the sea.

The production of the flue gases may occur by combustion of fuels containing vital elements and/or containing other materials which on their combustion form protective substances. However, it is also possible to enrich the flue gases with vital elements and/or protective substances after they have been produced. Post-combustion enrichment of flue gases with vital elements and/or protective substances is preferred if the respective substances are sensitive to temperature or if they cannot be produced by combustion. For many applications, it is advantageous to use customary fuels for the production of the flue gases according to the invention, e. g. oil or petrol. Additives, which on combustion form a vital element composite fraction and/or a protective composite fraction in the flue gas which has developed, preferably exist in the form of oil- or petrol-soluble compounds in a molecular-dispersed distribution. Table 1 lists examples of substances which may be utilized as fuels or fuel additives to produce the flue gases according to the invention. Table 2 lists examples of protective substances which may be added to the flue gas after combustion and table 3 lists examples of protective substances and/or substances containing vital elements as flue gas components produced by combustion. Table 4 contains further examples of protective substances. Table 5 lists examples of those substances from which protective substances in the troposphere can be autonomously formed.

The production of the flue gases according to the invention may take place by combustion in any type of combustion apparatus. Production may also take place by means of vehicles driven by fuels according to the invention, in particular by means of aircraft, ships and motor vehicles. Production may also take place by means of devices which are constructed to exclusively serve this purpose.

The production of tropospheric volume elements according to the invention by the release of customary available protective substances and vital elements is not preferred if the materials are solid materials. The protective substances and vital elements of finest granulation available on the market are so-called pyrogenic oxides. Examples of these types of commercial products are "Aerosil" (=silicon dioxide) and titanium oxide pigments (the latter lacking the protective coating which prevents the production of hydroxyl radicals). Even if released in the finest granulation available, these dusts have the disadvantageous property that they only remain for a short time because they settle quickly. Contrary thereto, certain applications permit the advantageous distribution of gaseous protective substances and gaseous vital elements in a tropospheric volume element even without the aid of flue gas. Examples of vital elements are, for instance, phosphorus, nitrogen, silicon and iron which are essential for the existence of living organisms.

Examples of protective substances are those substances which directly trigger off destruction, removal or neutralization of hazardous substances, or substances which enable living organisms to avoid contact with hazardous substances. Substances belonging to the protective substances are, for example, hydroxyl radicals in the troposphere because they cause the decomposition of dangerous reductive substances such as e. g. methane, smog and flue gases. Substances belonging to the protective substances are also those substances which stimulate the production of hydroxyl radicals in the troposphere, e. g. oxides containing titanium. Substances belonging to the protective substances are also contaminant-sorbents such as soot, pyrogenous silicic acid, iron (III)-oxide, fog and substances forming fog. Also belonging to the protective substances are warning substances which due to color, smell or irritating effects stop living organisms and man in particular from coming close to a dangerous substance or from eating food or drinking water contaminated by the dangerous substance. Also belonging to the protective substances are, for instance, the color pigments soot and red iron oxide, the intensively smelling substances ethyl mercaptan and pyridine, the irritants chloracetophenone and trichloronitromethane, taste-intensive substances or aromatic substances and substances which cause disgust or nausea.

Some examples of the volume elements enriched with vital elements and/or protective substances according to the invention, are:

- the tropospheric volume element over the sea which is preferably enriched with aerosols containing vital elements e. g. iron and phosphorus in oxide bonding for the growth of phyto-plankton, and protective substances e. g. titanium in oxide and/or nitride bonding which may trigger off the photolytic production of hydroxyl radicals to decompose methane and other undesirable tropospheric gases. The aerosols contribute directly or indirectly to the increase in the troposphere's retro-radiating effect (Albedo). The advantageous effect of this tropospheric volume element on the climate, energy supply and world nutrition is explained by way of example in FIG. 1. In FIG. 1:
  - The flow path indicated by bold-type arrows in FIG. 1 represents the non-tectonic share of the earth's short-term carbon cycle which is maintained by the photosynthesis of the phyto-plankton. Compared to the presently existing transient equilibrium, the transient equilibrium achieved by the tropospheric volume element according to the invention is marked by a lower atmospheric carbon dioxide level, a considerable rise is carbon load quantity and by a shorter carbon cycle completion period.
    - The fossil energy resources will become less important when the use of kerogene sediment and methane sediment as renewable energy sources begins.
- the tropospheric volume element over land or coastline regions marked by high levels of traffic and industry emissions is preferably enriched with aerosols containing protective substances such as titanium in oxide bonding, which stimulates here the photolytic decomposition of smog, nitrogen oxides, carbon monoxide, halogen and nitric aromatics and other undesirable combustion and emission products, and also protective substances such as iron in oxide bonding which causes the absorbent bonding of the emission products originating from the wear of friction-coating materials, in particular of carcinogenic antimony and toxic lead.
- the enclosed and artificially illuminated tropospheric volume element in tunnels or multi-storey car parks and underground car parks which is preferably enriched with aerosols containing protective substances such as titanium and cerium in oxide bonding which here also trigger off the photolytic decomposition of nitrogen oxides, carbon monoxide and other undesirable combustion products, and also, for example, absorb the emission products antimony and lead originating from the wear of friction-coating materials such as e. g. iron in oxide bonding.

the tropospheric volume element over land and coastline regions marked by a deficiency of essential elements, e. g. iodine, selenium, manganese and molybdenium, which is preferably enriched with gases and/or aerosols containing the missing vital elements. The essential elements are preferably linked by absorptive or chemical-absorptive bonding to aerosol carriers, e. g. soot or iron oxides produced by combustion.

Belonging to the tropospheric volume elements enriched with protective substances according to the invention are also those clouds which have been produced by the most devastating nuclear power plant accidents, such as were produced by the nuclear power plant at Chernobyl, which float in the troposphere and are enriched with radioactive elements. This also includes other clouds enriched with radioactive elements which may escape from other sources due to an uncontrollable nuclear reaction; some examples are, for instance, nuclear waste dumps, nuclear fuel rod depots, nuclear reactors for powering ships, nuclear weapons and their storage facilities, enriched uranium and plutonium depots. Flue clouds from fires or clouds of highly toxic or pathogenic potential which may exist in the troposphere due to accidents or disasters in depots and production facilities for poison gas, bacteriological weapons or laboratories and technological facilities handling these sorts of toxic or pathogenic materials are also among the tropospheric volume elements enriched with protective substances according to the invention.

The protective substances used for this purpose can be classified with one or more substances from the substance groups for marking materials, absorbents, substances stimulating precipitation, substances supporting condensation, substances supporting particle-agglomeration and substances which obstruct an intake of matter in the organism. The clouds carrying contaminants and enriched with protective substances and the contaminated sediment which has fallen from them or the contaminated water that has made contact with them may be identified by anybody due to one ore more protective substances from the pigment, smell, taste and irritant substance groups by sight, by smell, by taste and also by skin irritation and can thereby be avoided. Restricted to smell and skin irritation, the same also applies to animals. Several examples for these kinds of marking materials are given in table 2. In addition, these contaminated tropospheric volume elements are preferably enriched with protective substances which bind the pollutants, stimulate their precipitation and directly obstruct their intake by the organism.

According to the invention, the clouds containing contaminants are enriched with protective substances. These directly or indirectly obstruct or prevent the intake of radioactive, toxic or virulent substances by human or animal organisms, and even by plants. This considerably lowers the effects of the toxic emissions released.

In case of an accident, the production of tropospheric volume elements enriched with protective substances is carried out by safety installations specifically constructed for this purpose. The operation of such safety installations is described below by using an accident with released radioactive emissions from an uncontrollable nuclear reaction in a nuclear power plant as an example. This sort of accident is known by the term MCA (maximum credible accident). The buoyant hot gases released due to nuclear fission reactions of this kind can be classified as flue gases, due to the participation of high-temperature chemical combustion processes. One major risk emerging from an MCA is the release of radioactive iodine isotopes. To minimize the risk potential of the iodine emissions containing radioactivity, the fuel according to the invention and/or the fuel additive with iodine as protective substance are stored inside the nuclear power plant. In case of an MCA, the fuel may be burnt near to the focus of the open nuclear fuel reaction. This may be done, for example, by injection of liquid fuel doped with iodine by means of one or more jet lances arranged in the direct vicinity of the point of nuclear fuel reaction, whereby the heat of the nuclear reaction will inflame the liquid fuel. It is also possible to use natural gas enriched with hydroiodic acid as fuel and to burn this off accordingly. Hereby, the flue gases according to the invention mix with the flue gases produced by the MCA. The safety installation may also be realized by a customary combustion device by using customary oil and gas burners to release the combustion products according to the invention and containing iodine from the fuel and fuel additives. As fuels, fuel oils or oil additives doped with iodine are preferred. The emission of radioactive iodine from the MCA flue gases into the troposphere is preferably exceeded many times over, in relation to the amount of radioactive iodine released in a certain period of time into the troposphere, by the emission of iodine with the flue gases according to the invention to minimize the hazard of persons taking in radioactive iodine isotopes when they come into contact with the emissions at the location of the emissions.

The enrichment of the emitted contaminant cloud with protective substances from the category of solid and/or liquid absorbents enables an additional reduction in the intake of harmful substances from the contaminated cloud. Soot has the capacity to absorb gaseous radioactive substances. It may easily be produced as flue gas containing soot by the incomplete combustion of soot oil. Iron in organic bonding and/or manganese contained in the fuel result in flue gases enriched with iron and/or manganese oxides which are excellent absorbents of radioactive heavy metals. In the buoyant hot flue gases buoyant from the core melt and on its way to the troposphere, the soot aerosol will be oxidized superficially. Soot oxidized in this manner has the additional capacity of binding parts of the heavy radioactive elements.

Raising the contaminated cloud's steam content and/or the content level of substances which form fog will support the bonding of radioactive metals to the absorbent protective substances. The bonding of radioactive heavy metals, metalloids and earth-alkali with the oxidized soot-particle protective substances and/or oxide-particle protective substances succeeds most advantageously in the watery phase because this phase induces the production of dissolved ions which may be more easily absorbed by the absorbents soot and iron oxides. To enable the production of watery protective substance aerosols even in a dry tropospheric environment, the contaminated cloud may be enriched additionally with protective substances which form fog. The fog-forming substances can be produced by combustion as well as by injection of the fog-forming substances into the hot flue gases. Apart from water, the fog-forming substances are, for example, volatile acids, volatile bases, volatile hydrolytic salts and thermally decomposing salts as well as hygroscopic substances or also those substances which may transform into one or more fog-forming substances in the cloud which is enriched with protective substances. Belonging to the fog-forming substances are those substances which are listed by example in tables 3 and 4.

Fog-forming substances can also be directly produced from fuels, for example, phosphorus acid from the combustion of trikresylphosphate and sulfuric acid from the combustion of carbon disulfide. In a cloud, these substances or their oxidation products and/or hydrolysis products produce watery fog droplets of protective substance. The forming of fog has the advantage that it aggregates the aerosol particles in the cloud into flakes by agglomeration. This increases the sinking speed of the particles up to them forming precipitation. Preferably, water-soluble hygroscopic protective substances are used to form protective substance fog whereby ammonium chloride, calcium chloride, magnesium chloride or zinc chloride are preferred. The combination of volatile bases with volatile acids also results in advantageous and stable protective substance fogs. The combustion of metal dusts such as zinc, aluminum, iron or magnesium or mixtures of these substances with organic compounds of high chlorine content also permits the production of stable protective substance fogs.

It is of advantage to choose a high charging density of protective substances to enrich the contaminated cloud. On the one hand, this measure causes the majority of the inherent contaminants to bond and on the other, it causes the protective substance aerosols to agglomerate and sedimentate faster than the cloud without protective substances. This results in the advantage of restricting the region which is affected by fall-out to a many times smaller area than would have been struck without applying the described measure. The protective substances according to the invention, soot and iron oxide, possess pigment characteristics and therefore offer a simple method of visibly marking the fall-out area with black or red fall-out color. The contaminant bonding to the protective substances has the further advantage that the radioactive particles can be easily separated from the contaminated air by means of air purification devices and the contamination of water due to dissolved radioactive substances can be reduced.

In addition, protective substances which are identifiable by smell and/or skin irritation are suitable as sensory marking means for the radioactive cloud and its emissions. Examples of these substances may be found in the groups of smell-intensive and/or skin-irritating substances. These are, for instance, mercaptans (smell-intensive), pyridine (smell-intensive), halogen ketones (skin-irritating), halogen nitrites (skin-irritating), cyanogen halides (skin-irritating), trichloronitromethane (skin-irritating), halogen-nitro aromatic substances (skin-irritating), oxazepine (skin-irritating) and similar substances. Another way to prevent humans and animals from drinking water affected by the fall-out is to add aromatic substances with an intensive disgusting taste as protective substances. These protective substances, which would decompose if exposed to high temperatures, are preferably injected as gas or spray mist into the active hot flue gas current after the above-mentioned flue gases according to the invention with the protective substances have been added. Examples of protective substances having the described signal and protection properties which may be released into the flue gas of an MCA are listed in table 2. To protect the substances sensitive to temperature and oxidation in the cloud from decomposition by UV-radiation and oxidation, it is of advantage if the flue gas current contains light-refracting or light-absorbing pigments e. g. soot and oxides because the protective substances adsorbed by such pigments are better protected from chemical decomposition.

The interactive mechanisms, described in the example where the radioactive cloud caused by an accident is enriched with the protective substances according to the invention, may also be applied correspondingly to accidents where gas clouds are released which contain toxics or viruses or microbes. In those cases where an accident causes a gas release without fire or explosion and where there is no influence by thermal convection, it may be helpful in an urban neighborhood to start a fire to produce the flue gases containing protective substances to provide the gas cloud with thermal lifting power which lifts the gas cloud up and away from the most endangered localities.

The local tropospheric volume elements enriched with protective substance aerosols in which the production of hydroxyl radicals is stimulated by radiation can make the customary catalysts systems, serving to purify the exhaust gases of motor vehicles, obsolete. The effect of the fine distribution of aerosols according to the invention is better than the effects of solid-bedded catalysts because the aerosols can keep on taking effect within the flue gas cloud, wherever this may go, even after having left the vehicle's exhaust. The smog components ozone, NOx and peroxyacetylnitrate are thereby decomposed by the hydroxyl radicals produced or, in environments where the daytime concentration of OH-radicals exceeds the usual level significantly, cannot even be formed at all. Protective substance aerosols containing iron in oxide-bonding securely bind carcinogenic antimony and toxic lead from the wear of clutch and brake pads even after precipitation washes them away and they are sedimentated with the protective substance particles or they are washed into the sewage system with the rainwater. Protective aerosols which settle from the air onto the surfaces of vegetation, buildings and the ground can continue to produce hydroxyl radicals due to radiation and can continue their purifying function.

The release of flue gases which produce protective substances could be subsidized, for instance, by introducing a fuel tax exemption or fuel tax reduction for motor vehicles which are mainly used during the day for these particular fuels so that fuels which produce flue gases containing protective substances may find widespread use as an alternative to catalysts. Equipping vehicles with catalytic devices for exhaust gas purification, as is the regulation particularly for cars with gasoline engines, would then not be necessary.

To achieve a lasting climate stabilization in the moderate phase and to increase food production and renewable energy sources, it would suffice just to make use of the tropospheric volume element enriched with vital elements and protective substances over the sea. Therefore, controlling and monitoring the enrichment of the tropospheric volume elements over the sea with vital elements and/or protective substances is particularly important because as the addition of vital elements increases, the throughput in the non-geogenic carbon cycle increases, whereby the lasting stability of the transient equilibrium of the carbon cycle must be secured.

The increase in the carbon load conveyed in this part of the carbon cycle therefore requires that the carbon load taken from the troposphere by the mass growth of phyto-plankton resulting from the enrichment of the tropospheric volume element, according to the invention, over the sea must be replaced to a sufficient extent. In the transitive phase, replacement may take place by the combustion of fossil fuels. After this phase, the products arising from the increased production of phyto-plankton, namely kerogen hydrate sediments and methane hydrate sediments, should be integrated in the energy production of the anthropogenic material economy. Otherwise, there is a danger that due to the falling concentration of carbon dioxide in the troposphere, the climate could slip into a cold phase.

The system components of the carbon cycle, which may be modified by human intervention in order to sustain a stable carbon transient equilibrium, as a result of the enrichment of the oceanic tropospheric volume element with vital elements and protective substances are underlined below:

(1) Carbon dioxide load form the sources:
Combustion of renewable energy carriers and volcanic exhalation→(2)

(2) Carbon dioxide sinks:
Assimilated carbon dioxide load in phyto-plankton, geogenic bonding in the course of the decaying process as limestone sediment and limestone sediment subduction in the earth's crust and the earth's mantle→(3a), (3b)

(3a) Phyto-plankton load into the food pyramid (3b) Phyto-plankton load into the oceanic sediment fermentation→(4)

(4) Kerogen sediment load and methane hydrate sediment load from sediment fermentation→(5)

(5) Kerogen sediment load and methane hydrate sediment load by sediment mining to be fed into the anthropogenic material cycle→(6)

(6) Combustion of the kerogen sediment load and methane hydrate sediment load for anthropogenic energy gain→(1)

A number of examination parameters permit controlling the stability of the carbon cycle's transient equilibrium with the increased carbon load rate induced. These examination parameters are preferably gained from ecological systems which are directly influenced and from other environmental systems which are affected. Controlling of the carbon load rate takes place by raising or lowering the content of vital elements and/or protective elements in the tropospheric volume element and/or protective substances according to the invention. This is achieved according to the invention by the continuous or sporadic dosage of the additive agents distributed via the airspace and by determining the position of the respective location of distribution depending strictly on the actual status and change in the respective parameters recorded. Such parameters are for example:

- regional, hemispheric and global contents of methane and dimethyl sulfide measured at different heights in the troposphere and above the tropopause;
- regional and hemispheric contents of protective substances and/or vital elements in the air, on/in vegetation, on/in the ground and in waters;
- average covering of cloud in the tropospheric volume element;
- carbon dioxide contents measured in the air and sea water, globally, in the hemisphere and in the tropospheric volume element;
- concentration of phyto-plankton below the tropospheric volume element;
- oxygen content of sea water beneath the tropospheric volume element at different depths;
- content of turbid matter in sea water beneath the tropospheric volume element at different depths;
- sedimentation rates in the sea beneath the tropospheric volume element at different depths;
- studying the ecological systems beneath the tropospheric volume element;
- measuring global temperature in the troposphere, on the surface of the ground and on the surface of the sea.

The concentration of vital elements and/or protective substances in the tropospheric volume element, the volume of the tropospheric volume element and the surface covered by the tropospheric volume element influence the carbon throughput. Potential ways to influence the parameters of tropospheric volume elements charged with vital elements and/or protective substances exist in considerable variety. The average distribution, duration of stay and concentration of the substances released into the tropospheric volume element with the flue gases are here important quantities. Some examples of what can be controlled are:

- the location over which the flue gas is released;
- the extent of the area over which the flue gas is released;
- the height above ground or sea level at which the flue gas is released;
- the concentration of substances in the flue gas;
- the dosage of flue gas released;
- the composition of the substances released with the flue gas;
- the intervals at which the flue gas is released;
- the size of the particles of the substances in the flue gas.

Regarding the size of the particles in the aerosols in the flue gas, the size of the secondary particles is the preferred measured quantity because the diameter of the secondary aerosol particles has an essential and decisive influence on their sinking velocity. The secondary particles consist of agglomerated primary particles. The diameters of the secondary particles are a function of the aerosol concentration in the flue gas. The aerosol concentration itself is a function of the concentration of the aerosol-forming inflammable substance in the fuel: the higher the concentration, the coarser the secondary particles in the flue gas will be and the faster they will sink in the troposphere.

Similar control mechanisms may be used with the dosage of additive agents, applicable for accidents. These control mechanisms are oriented, for example, according to the status of the data on the contaminant load constantly supplied to the cloud which in the case of a nuclear power plant accident can be assessed quite accurately from the radiation temperature of the core melt and/or the height of the thermal convection column and/or from the column's radioactive radiation intensity. From the spectrum of the radioactive radiation intensity and the knowledge of the nuclear fuel type used, it is possible to conclusively identify the active composites present in the emission. These criteria are also suitable for determining the necessary amounts of load of the protective substances. It may also be decided from case to case if all the protective substances or only a certain fraction of the protective substances are to be used.

Tropospheric volume elements with an increased content of vital elements have the specific advantage that the distribution of the vital elements latter over sea or land is lasting and extensive. Attempts which have been made to release vital elements in the form of iron salts which were directly released into the sea were only able to stimulate mass growth of phyto-plankton in small areas.

It is also possible to separate flue gases according to the invention, which have been released in closed buildings, from the air which has been treated accordingly by utilizing the flue gases' aerosols which contain titanium and/or iron which form hydroxyl radicals under the influence of sunlight or artificial light sources after they have fulfilled their task of neutralizing harmful gases by means of the commonly known processing steps of air purification by dust extraction. By using this method, the flue gases may also be used to purify waste air or fresh air containing harmful gases.

With the enrichment of the oceanic tropospheric volume element with vital elements and/or protective substances according to the invention, it is possible to ward off the climate crisis threatening mankind on a lasting basis. A selection of individual effects are:

Lowering the troposphere's $CO_2$ content (leads to climate cooling);

Albedo increase directly effected by the aerosols according to the invention (leads to climate cooling);

Albedo increase by cloud formation caused by increased dimethyl sulfide emissions from phyto-plankton metabolism (leads to climate cooling);

Decomposition of tropospheric methane by the production of hydroxyl radicals (leads to climate cooling);

Decomposition of substances which are difficult to decompose, e. g. poly-chlorinated biphenyls, halogenated dibenzodioxins and dibenzofurans, DDT, phthalates, polycyclic aromatics, by the production of hydroxyl radicals;

Increase of necrotized phyto-plankton sedimentation (leads to the production of kerogen hydrate sediments and methane hydrate sediments as a source for renewable energy products);

Increase of protein production in the oceanic ecological system by increasing the mass of phyto-plankton in sea water (leads to an increase in protein food resources).

The mixed oxides and nitrides required to produce the additives to be released into the tropospheric volume elements are all non-toxic and, in the applicable concentrations, they do not have a negative effect on the lungs or on the digestive system. They do not cause toxic effects on the environment either. At least, there is no evidence that natural particles of similar constitution—such as may be released in considerable quantities from the tropospheric hydrolysis of iron halogenics, silicon halides and titanium halides contained in volcanic gas exhalations—have ever caused damage to the health.

No negative effects have become known so far from the operation of stationary domestic heating systems fuelled with oils containing iron either. Neither the ubiquitous iron oxides and manganese oxides nor the various oxides, nitrides and oxide-nitrides, which can result from combustion of the elements silicon, titanium, zirconium and iron, which are preferably used elements, possess toxic qualities. Only the quartz modifications of the corresponding silicon compounds and titanium compounds have been proven to be harmful to the health. The aerosols released into the troposphere due to the commonly known combustion of silicon, titanium, silane, titanium acid esters and silicic acid esters are non-crystalline. There are also no hazardous effects known to emanate from non-crystalline silicon dioxide aerosols. The titanates, ferrates, zirconates, zirconium dioxide and cerium dioxide which may be used as composites of the aerosols according to the invention also have, to a great extent, disordered non-crystalline grid structures which belong to the inert substances in chemical/biological terms. In sandy sediments of decayed crystalline and volcanic rocks and in volcanic ashes, these elements sporadically in the decay-resistant fraction of heavy minerals as rutile, anatase, brookite, ilmenite, titanite and zircon. Harmful effects of these substances when taken into the digestive system are therefore not known and are not to be expected.

The natural burden due to the wind-borne fraction of fine-dust aerosols can be expected to increase worldwide, if the enrichment of the tropospheric volume elements with vital elements and/or protective substances according to the invention is not put into practice, due to the continuing growth of deserts and steppes. In many regions, the natural wind-borne aerosols contain crystalline composites, in particular quartz and serpentine, which when inhaled are harmful to the health. Particularly, the natural fine-dust aerosols coming from desert belts and moraine belts which occasionally spread to central Europe can be classed as being harmful to the health due to their content of quartz. In particular, the fine dusts containing serpentine fiber which are blown out of natural serpentine deposits in dry zones are recognized as being harmful to the health.

Particularly, the organic compounds of titanium, silicon, phosphorus and iron required for the production of the fuels and fuel additives for producing the flue gases enriched with vital elements and/or protective substances can be produced on a large scale at low costs. Moreover, titanium and iron are not scarce elements in the earth's crust, but belong to the most frequent elements. The continental earth's crust has an average content of iron of 42 g pro kg and an average content of titanium of 5 g pro kg. According to the 1992 volume of the Federal German statistical almanac, the fuel consumption of motor vehicles, aircraft and diesel engines in 1990 amounted to about 457,000,000 metric tons just in the U.S.A. Assuming that about one fifth of this quantity has been used for appropriate purposes (air traffic, shipping) about 10,000 metric tons of doping elements could have been released by a medium concentration of doping elements of $10^{-4}$ parts pro unit of fuel.

TABLE 1

Examples of substances used as fuels or fuel-additives with which flue gases can be produced by combustion permitting the enrichment of tropospheric volume elements with vital elements and/or protective substances

| Example of substances; Element symbol of the effective elements in the flue gas containing additive agents | Properties of the effective substances applied to the flue gas* |
|---|---|
| Phosphorus acid ester; P | a, p |
| Phosphoric acid ester; P | a, p |
| White phosphorus; P | a, p |
| Magnesium phosphide; P | a, p |
| Calcium phosphide; P | a, p |
| Silicic acid ester; Si, N | a |
| Tetramethyl silane; Si, N | a |
| Silane compounds; Si, N | a |
| Halogene silane compounds; Si, N | a |
| Silicon-magnesium alloys; Si, N | a |
| Titanocene; Ti, N | a, d |
| Tetramethyl titanium; Ti, N | a, d |
| Hydrolysis-resistant titanium acid | a, d |
| esters; Ti, N | a, d |
| Condensates of carboxylic acid - | a, d |
| titanium acid; Ti, N | a, d |
| Titanium acetylacetonates; Ti, N | a, d |
| Titanium phthalocyanines; Ti, N | a, d |
| Titanium; Ti, N | |
| Magnesium-titanium alloys; Ti, N | |
| Iron carbonyls; Fe | a, d, p, s |
| Ferrocene; Fe | a, d, p, s |
| Dekamethyl ferrocene; Fe | a, d, p, s |
| Iron oleates; Fe | a, d, p, s |
| Fatty acidic iron salts; Fe | a, d, p, s |
| Iron-acethylacetonate Fe | a, d, p, s |
| Iron rhodanide; Fe | a, d, p, s |
| Aromatic N-heterocyclics containing | a, d, p, s |
| iron; Fe | a, d, p, s |
| Iron-silicon-magnesium alloys; Fe, Si | |
| Tricyclopentadienyl-cerium; Ce | d |
| Cerium heptane dionate; Ce | d |
| Cerium acetyl acetonate; Ce | d |
| Iron-cerium-titanium alloys; Fe, Ce, Ti | a, d, p, s |
| Iodine methane; I | a, r |
| Diiodine methane; I | a, r |
| Tetraiodine methane; I | a, r |
| Iodine; I | a, r |
| Iodine dissolution in soot oil; I, C | a, p, r, s |
| Diphenyl selenide; Se | a |
| Diphenyl selenium dioxide; Se | a |

TABLE 1-continued

Examples of substances used as fuels or fuel-additives with which flue gases can be produced by combustion permitting the enrichment of tropospheric volume elements with vital elements and/or protective substances

| Example of substances; Element symbol of the effective elements in the flue gas containing additive agents | Properties of the effective substances applied to the flue gas* |
|---|---|
| Diphenyl selenium oxide; Se | a |
| Selenium dissolution in soot oil; Se, C | a, p, s |
| Diphenyl selenide with ferrocene; Se, Fe | a, p, s |
| Soot oil; C | p, s |
| Soot oil with ferrocene and tetraiodine methane; C, Se, Fe | a, p, s |
| Soot oil with ferrocene; C, Fe | p, s |

*Property a) vital element,

Property d) protective substance; production of hydroxyl radicals

Property p) protective substance; absorbent

Property r) protective substance; minimization of the intake of radioactive iodine by the organism Property s) protective substance; marking the toxic fall-out from a contaminated cloud by visible pigmentation

TABLE 2 a) Examples of protective substances as direct additives or as flue gas additives which are to be released into contaminant clouds caused by accident
b) Examples of the flue gases used

| a) Protective substances added to flue gas | b) Flue gas example | Direct and indirect properties of the protective substances in the contaminated cloud and its fall-out* |
|---|---|---|
| a) Chlorine acetophenone | b) Flue gas: Gas mixture containing soot, hydroiodic acid and iron (III) oxide at a temperature of 150° C. Flue gas from the waste gases of the separate combustion of soot oil methyl-iodide solution and ferrocene oil solution | p, r, s, u, t |
| a) Ethane thiol | b) Flue gas: Flue gas containing soot from the combustion of soot oil | p, s, t |
| a) Pyridine | b) Flue gas: Gas and aerosol convection current which swirls up due to the uncontrolled reaction of the core melt | t |

*Property p) absorptive bonding to a protective substance
Property r) minimizing the intake of radioactive iodine by the organism
Property s) protective substance: marking the toxic fall-out from a contaminated cloud by visible pigmentation
Property t) marking the toxic emissions in the air and the toxic fall-out on the ground and in waters by smell or taste
Property u) marking the toxic emissions in the air and the toxic fallout on the ground and in waters by skin irritation or other irritation

TABLE 3

Examples of vital elements and protective substances in the flue gas and the effects in the tropospheric volume element doped with them

| Examples of substances containing vital elements and/or protective substances and the effective elements contained therein | Symbol(s) of the effective element(s) | Effect in doped tropospheric volume element |
|---|---|---|
| Pyrophosphorus acids<br>Mixed phosphorus acids fog<br>Ammonium phosphates | P | a, p |
| Silicon-dioxide-aerosol | Si | a |
| Silicon nitride-oxynitride-aerosol | N | |
| Titanium-dioxide-aerosol<br>Titanium-oxynitride-aerosol<br>Titanium-silicon-mixoxide-aerosol<br>Titanium-silicon-mixoxynitride-aerosol<br>Titanium-silicon-zirconium-mixoxide-aerosol<br>Titanium-silicon-zirconium-mixoxynitride-aerosol | Ti, Si, Zr, N | a, d, s |
| Iron (III) oxide-aerosol | Fe | a, p, s |
| Iron-silicon-magnesium-mixoxide-aerosol<br>Silicon nitride-oxidnitride-aerosol | Fe, Si, Mg, N | a, p, s |
| Cerium-dioxide-aerosol | Ce | d |
| Thinned iodine gas<br>Thinned iodine-hydrogen gas<br>Soot aerosols containing iodine | I, C | a, p, r, s |
| Thinned selenium-dioxide gas | Se | a, |
| Selenium-dioxide-iron(III)oxide-aerosols | Se, Fe | a, p, s |
| Soot aerosols containing selenium | Se, C | a, p, s |

Property a) vital element

Property d) protective substance; production of hydroxyl radicals

Property p) protective substance; absorbent

Property r) protective substance; minimization of the intake of radioactive iodine by the organism Property s) protective substance; marking the toxic fall-out from contaminated clouds by visible pigmentation

TABLE 4

Examples of fog-forming substances as protective substances as direct additives or as flue gas additives which are to be released into contaminant clouds caused by accident

| |
|---|
| Water |
| Hydrochloric acid |
| Ammonia water |
| Ammonia gas |
| Methyl amine |
| Ethyl amine |
| Sodium carbonate |
| Ammonium carbonate |
| Calcium chloride |
| Magnesium chloride |
| Aluminum chloride |
| Iron(III) chloride |
| Ammonium hydrogen carbonate |
| Ammonium chloride |
| Methyl ammonium chloride |
| Ammonia hydrogen sulfate |
| Chlorine sulfonic acid |
| Sulfur trioxide |
| Pyridinium chloride |
| Phosphorus pentoxide |

TABLE 5

Examples of substances which convert into fog-forming protective substances only within the contaminant clouds caused by accident

| Examples of substances which convert into fog-formers in the contaminant cloud | Fog-formers which are produced from substances in the contaminant cloud |
|---|---|
| Hydrogen sulfide | Sulfuric acid |
| Ammonium sulfide | Ammonium sulfate |
| Sulfur dioxide | Sulfuric acid |
| Carbon disulfide | Sulfuric acid |
| Phosphorus trichloride | Phosphorus acid, Hydrochloric acid |
| Phosphorus oxychloride | Phosphorus acid, Hydrochloric acid |
| Phosphorus pentachloride | Phosphorus acid, Hydrochloric acid |
| Sulfur dichloride | Sulfuric acid, Hydrochloric acid |
| Sulfuryl chloride | Sulfuric acid, Hydrochloric acid |
| Aluminum chloride | Hydrochloric acid, Aluminum hydroxide |
| Iron (III) chloride | Hydrochloric acid, Iron (III) hydroxide |
| Boron trichloride | Hydrochloric acid, Boric acid |
| Titanium tetrachloride | Titanium acid, Hydrochloric acid |
| Silicon tetrachloride | Silicic acid, Hydrochloric acid |
| Chlorine silane | Silicic acid, Hydrochloric acid |

The invention claimed is:

1. Method for producing a tropospheric volume element having a lasting enriched concentration of at least one vital element (essential element) andlor at least one protective substance in comparison to its presently existing composition of elements and matter, wherein said at least one vital element and/or said at least one protective substance is chosen from the group consisting of iron compounds and titanium compounds, characterized in that the volume element is produced by a controlled addition of flue gas that contains said at least one vital element and/or said at least one protective substance, whereby said flue gas is produced by combustion of fuel and/or fuel additives.

2. Method according to claim 1, characterized in that the additives contain iron and/or titanium in elementary form and/or in a chemical compound, the chemical compound being oil- or petrol-soluble, and/or in a metal and/or in an alloy, the alloy being an iron-silicon-magnesium alloy, a magnesium-titanium alloy or an iron-cerium-titanium alloy.

3. Method according to claim 1, characterized in that the fuel contains one or more substances selected from the group consisting of hydrogen, natural gas, liquid gas, mineral oil, refined mineral oil products, pyrolysis oil, oils processed from renewable raw materials, diesel oil, kerosene, light oil, heavy oil, silicon oil, gasoline, methanol, metal, and metalloid and containing, in enriched form, at least one vital element and/or at least one substance which on pyrolysis and/or on combustioli results in its conversion into a protective substance.

4. Method for the removal of contaminants or toxic substances from a tropospheric volume element, characterized by adding flue gas containing protective substances chosen from the group consisting of iron compounds and/or titanium compounds, whereby said flue gas is produced by combustion of fuel and/or fuel additives.

5. The method of claim 4, wherein the contaminants or toxic substances are radioactive elements.

6. The method of claim 4, wherein the contaminants or toxic substances are microbes.

7. Method for photolytic purification of waste air or fresh air currents, characterized by adding flue gas containing protective substances chosen from the group consisting of iron compounds andlor titanium compounds, whereby said flue gas is produced by combustion of fuel and/or fuel additives.

8. Method for increasing the growth of phyto-plankton under a tropospheric volume element produced according to claim 1, comprising:

enriching a global or regional tropospheric volume element with vital elements and/or protective substances in a controlled manner, whereby the dosage of vital elements and/or protective substances leads to an average distribution, duration of stay and concentration in the tropospheric volume element, whereby the vital elements and/or protective substances are iron compounds and/or titanium compounds, and whereby the vital elements and/or protective substances are transported by flue gas into the trospospheric volume element.

9. Method for cooling the troposphere, characterized by a controlled addition of flue gas containing protective substances chosen from the group consisting of iron compounds and/or titanium compounds, whereby said flue gas is produced by combustion of fuel andlor fuel additives.

10. Method for reducing the carbon load of the troposphere and for thereby achieving a lasting climate stabilization, characterized by enriching a global or regional tropospheric volume element with vital elements andlor protective substances in a controlled manner, whereby the dosage of vital elements andlor protective substances leads to an average distribution, duration of stay and concentration in the tropospheric volume element, whereby the vital elements and/or protective substances are iron and/or titanium in oxide bonding, whereby the vital elements and/or protective substances are transported by flue gas into the tropospheric volume element.

11. Method for reducing the carbon load of the troposphere according to claim 10, whereby the amount of vital elements and/or protective substances and the position of the respective location of distribution depends on one or more of the following parameters:

regional, hemispheric and global contents of methane and dimethyl sulfide measured at different heights in the troposphere and above the tropopause;

regional, and hemispheric contents of protective substances and/or vital elements in the air, on/in vegetation, on/in the ground and in waters;

average covering of cloud in the tropospheric volume element;

carbon dioxide contents measured in the air and sea water, globally, in the hemisphere and in the tropospheric volume element;

concentration of phyto-plankton below the tropospheric volume element;

oxygen content of sea water beneath the tropospheric volume element at different depths;

content of turbid matter in sea water beneath the tropospheric volume element at different depths;

sedimentation rates in the sea beneath the tropospheric volume element at different depths; and/or studying the ecological systems beneath the tropospheric volume element.

* * * * *